US008430976B2

(12) United States Patent
Carroll et al.

(10) Patent No.: US 8,430,976 B2
(45) Date of Patent: Apr. 30, 2013

(54) RAIL STEEL WITH AN EXCELLENT COMBINATION OF WEAR PROPERTIES AND ROLLING CONTACT FATIGUE RESISTANCE

(75) Inventors: Robert Carroll, South Yorkshire (GB); Howard Martin Smith, South Yorkshire (GB); Shreekant Jaiswal, Chesterfield (GB)

(73) Assignee: Tata Steel UK Limited, London (GB)

( * ) Notice: Subject to any disclaimer, the term of this patent is extended or adjusted under 35 U.S.C. 154(b) by 59 days.

(21) Appl. No.: 12/867,631

(22) PCT Filed: Feb. 23, 2009

(86) PCT No.: PCT/EP2009/001276

§ 371 (c)(1),
(2), (4) Date: Oct. 28, 2010

(87) PCT Pub. No.: WO2009/103565

PCT Pub. Date: Aug. 27, 2009

(65) Prior Publication Data

US 2011/0038749 A1 Feb. 17, 2011

(30) Foreign Application Priority Data

Feb. 22, 2008 (EP) ..... 08101917

(51) Int. Cl.
*C22C 38/04* (2006.01)
*C22C 38/02* (2006.01)
*C22C 38/12* (2006.01)

(52) U.S. Cl.
USPC ..... 148/320; 148/581; 420/127; 420/128

(58) Field of Classification Search ..... 148/581, 148/584, 320; 420/127, 128
See application file for complete search history.

(56) References Cited

U.S. PATENT DOCUMENTS

| | | | |
|---|---|---|---|
| 2008/0011393 | A1 | 1/2008 | Ueda et al. |
| 2012/0076685 | A1 | 3/2012 | Honjo et al. |

FOREIGN PATENT DOCUMENTS

| | | | | |
|---|---|---|---|---|
| EP | 754755 | A1 | | 1/1997 |
| EP | 2006406 | A1 | | 12/2008 |
| JP | 9-111352 | A | | 4/1997 |
| JP | 2000-345296 | A | | 12/2000 |
| JP | 2005-171326 | A | | 6/2005 |
| JP | 2007-277716 | A | * | 10/2007 |
| JP | 2007291418 | A | | 11/2007 |

OTHER PUBLICATIONS

W.Ed Wegst, "Some Facts About Alloying and Accompanying Elements in Steel",—Wegst CW-Stahschlussel Stahlschiessel. Natchschlagewerk, Marbach, Verlag Stahlschlussel Wegst, DE, Germany vol. ED 1989, p. 7.*

Machine-English translation of Japanese patent 2007-277716A, Honjo et al., Oct. 25, 2007.*

Carroll et al.—"Rolling contact fatigue of white etching layer: part 1. crack morphology",WEAR, 262 (9-10), 1253-1266 CODEN: WEARAH; ISSN: 0043-1648, 2007, XP002500669, table 1.

* cited by examiner

*Primary Examiner* — Deborah Yee
(74) *Attorney, Agent, or Firm* — Novak Druce Connolly Bove + Quigg, LLP

(57) ABSTRACT

A high-strength pearlitic steel rail with an excellent combination of wear properties and rolling contact fatigue resistance wherein the steel has 0.88% to 0.95% carbon, 0.75% to 0.92% silicon, 0.80% to 0.95% manganese, 0.05% to 0.14% vanadium, up to 0.008% nitrogen, up to 0.030% phosphorus, 0.008 to 0.030% sulphur, at most 2.5 ppm hydrogen, at most 0.10% chromium, at most 0.010% aluminium, at most 20 ppm oxygen, the remainder being iron and unavoidable impurities.

20 Claims, 1 Drawing Sheet

Figure 1:
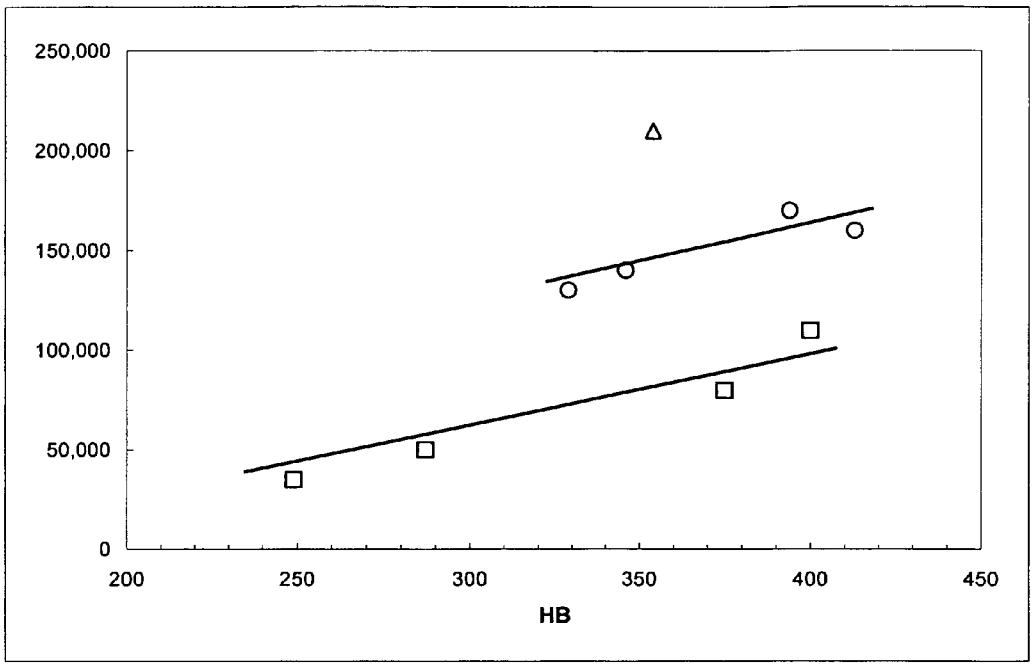

RAIL STEEL WITH AN EXCELLENT COMBINATION OF WEAR PROPERTIES AND ROLLING CONTACT FATIGUE RESISTANCE

CROSS-REFERENCE TO RELATED APPLICATIONS

This application is a §371 National Stage Application of International Application No. PCT/EP2009/001276, filed on 23 Feb. 2009, claiming the priority of European Patent Application No. 08101917.6 filed on 22 Feb. 2008.

FIELD OF THE INVENTION

This invention relates to a rail steel with an excellent combination of wear properties and rolling contact fatigue resistance required for conventional and heavy haul railways.

BACKGROUND OF THE INVENTION

Increases in train speeds and loading have made railway transportation more efficient. However, this increase also means more arduous duty conditions for the rails, and further improvements in rail material properties are required to make them more tolerant and resistant to the increased stresses and stress cycles imposed. The increase in wear is particularly heavy in tight curves with high traffic density and a greater proportion of freight traffic, and the drop of service life of the rail may become significant and undesirable. However, the service life of the rail has been drastically improved in recent years due to the improvements in heat-treatment technologies for further strengthening the rails, and the development of high strength rails using a eutectoid carbon steel and having a fine pearlitic structure.

In straight and gently curved parts of railroads where lower resistance to wear is required, repeated contacts between wheels and rails may cause rolling contact fatigue (RCF) failures on the surface of the rail head. These failures result from the propagation of fatigue cracks started at the top plane of the rail head surface into the interior thereof. The failures called 'squat' or 'dark spot' appear mainly, but not exclusively, in the tangent tracks of high-speed railroads and are due to the accumulation of damage on the centre of the rail head surface that results from the repeated contacts between wheels and rails.

These failures can be eliminated by grinding the rail head surface at given intervals. However, the costs of the grinding car and operation are high and the time for grinding is limited by the running schedule of trains.

Another solution is to increase the wear rate of the rail head surface to enable the accumulated damage to wear away before the defects occur. The wear rate of rails can be increased by decreasing their hardness as their wear resistance depends on steel hardness. However, simple reduction of steel hardness causes plastic deformation on the surface of the rail head which, in turn, causes loss of the optimum profile and the occurrence of rolling contact fatigue cracks.

Rails with a bainitic structure wear away more than rails with a pearlitic structure because they consist of finely dispersed carbide particles in a soft ferritic matrix. Wheels running over the rails of bainitic structures, therefore, cause the carbide to readily wear away with the ferritic matrix. The wear thus accelerated removes the fatigue-damaged layer from the rail head surface of the rail head. The low strength of the ferritic matrix can be counter-acted by adding higher percentages of chromium or other alloying elements to provide the required high strength as rolled. However, increased alloy additions are not only costly but may also form a hard and brittle structure in the welded joints between rails. These bainitic steels appear to be more susceptible to stress corrosion cracking and require a more rigid control of residual stresses. Moreover the performance of alumino-thermic and flash butt welding of bainitic steels should be improved.

Rails with a pearlitic structure comprise a combination of soft ferrite and lamellae of hard cementite. On the rail head surface that is in contact with the wheels, soft ferrite is squeezed out to leave only the lamellae of hard cementite. This cementite and the effect of work hardening provide the wear resistance required of rails. The strength of these pearlitic steels is achieved through alloying additions, accelerated cooling or a combination thereof. Using these means, the interlamellar spacing of the pearlite has been reduced. An increase in the hardness of the steel causes an increase in wear resistance. However, at hardness values of about 360 HB and higher, the wear rate is so small that a further increase in hardness does not result in a significantly different wear rate. However, improvements in resistance to rolling contact fatigue have been seen with increasing hardness up to ~400 HB which is generally regarded as the upper hardness limit for eutectoid and hypo-eutectoid steels with a fully pearlitic microstructure.

However, under practical conditions, the RCF resistance of these high strength pearlitic steels needs to be further improved to delay the initiation of rolling-contact fatigue cracks and thereby prolong the intervals between rail grinding operations.

SUMMARY OF THE INVENTION

It is therefore an object of this invention to provide high-strength rails that are resistant to rolling contact fatigue while retaining the excellent wear resistance of current heat treated rails.

The object of the invention was reached with a high-strength pearlitic rail steel with an excellent combination of wear properties and rolling contact fatigue resistance, containing (in weight %):

0.88% to 0.95% carbon,
0.75% to 0.95% silicon,
0.80% to 0.95% manganese,
0.05% to 0.14% vanadium,
at most 0.008% nitrogen,
at most 0.030% phosphorus,
0.008 to 0.030% sulphur,
at most 2.5 ppm hydrogen,
at most 0.10% chromium,
at most 0.010% aluminium,
at most 20 ppm oxygen,
the remainder consisting of iron and unavoidable impurities.

DETAIL DESCRIPTION OF THE PREFERRED EMBODIMENTS

The chemical composition of steels according to the invention showed very good wear properties compared to conventional hypo and hypereutectoid pearlitic steels. The inventors have found that the balanced chemical composition produces very wear resistant pearlite comprising very finely dispersed vanadium carbo-nitrides. Moreover, the RCF resistance is significantly higher than that of comparable conventional steels. A number of factors come together to bring about this improvement. Firstly, the move to the hypereutectoid region of the iron-carbon phase diagram increases the volume fraction of hard cementite in the microstructure. However, under the relatively slow cooling experienced by rails, such high concentrations of carbon can lead to deleterious networks of embrittling cementite at grain boundaries. The intentional addition of higher silicon and vanadium to the composition have been designed to prevent grain boundary cementite. These additions also have a second, and equally important, function. Silicon is a solid solution strengthener and increases the strength of the pearlitic ferrite which increases the resistance of the pearlite to RCF initiation. Similarly, the precipitation of fine vanadium carbo-nitrides within the pearlitic ferrite increases its strength and thereby the RCF resistance of this combined pearlitic microstructure. A further feature of the compositional design is to limit the nitrogen content to prevent premature and coarse precipitates of vanadium nitride as they are not effective in increasing the strength of the pearlitic ferrite. This ensures that the vanadium additions remain in solution within the austenite to lower temperatures and, therefore, result in finer precipitates. The vanadium in solution also acts as a hardenability agent to refine the pearlite spacing. Thus the specific design of the composition claimed in this embodiment utilises the various attributes of the individual elements to produce a microstructure with a highly desirable combination of wear and RCF resistance. Enhanced RCF and wear resistance can thus be achieved at lower values of hardness. Since the higher hardness is usually associated with higher residual stresses in the rail, the lower hardness means that these residual stresses in the rail according to the invention are reduced, which is particularly beneficial in reducing the rate of growth of fatigue cracks. The mechanical properties of the steels in accordance with the invention are similar to a conventional Grade 350 HT which is commonly used in tight curves and on the low rail of highly canted curves. A further improvement could be obtained by subjecting the rail to accelerated cooling after hot rolling or a heat treatment.

In an embodiment of the invention, the minimum amount of nitrogen 0.003%. A suitable maximum nitrogen content was found to be 0.007%.

Vanadium forms vanadium carbides or vanadium nitrides depending on the amounts of nitrogen present in the steel and the temperature. In principle, the presence of precipitates increases the strength and hardness of steels but the effectiveness of the precipitates decreases when they are precipitated at high temperatures into coarse particles. If the nitrogen content is too high, there is an increased tendency to form vanadium nitrides at high temperatures instead of fine vanadium carbides at lower temperatures. The inventors found that when the nitrogen content was less than 0.007% then the amount of undesired vanadium nitrides was small compared to the desired vanadium carbides, i.e. no detrimental effects of the presence of vanadium nitrides could be observed while the beneficial effect of the presence of finely dispersed vanadium carbides was strong. A minimum amount of nitrogen of 0.003% is a practical lower limit that maximises the effectiveness of the costly vanadium addition by ensuring that only a tiny fraction is tied up with the higher temperature relatively coarse vanadium nitride precipitates. A suitable maximum value for nitrogen is 0.006% or even 0.005%.

In an embodiment of the invention, the minimum amount of vanadium is 0.08%. A suitable maximum content was found to be 0.13%. Preferably, vanadium is at least 0.08% and/or at most 0.12%. In order to provide a fine distribution of vanadium carbo-nitrides, the inventors found that an amount of about 0.10% vanadium is optimum and preferable. The beneficial effect diminishes with increasing amounts and become economically unattractive.

Carbon is the most cost effective strengthening alloying element in rail steels. A suitable minimum carbon content was found to be 0.90%. A preferable range of carbon is from 0.90% to 0.95%. This range provides the optimal balance between the volume fraction of hard cementite and the prevention of the precipitation of a deleterious network of embrittling cementite at grain boundaries. Carbon is also a potent hardenability agent that facilitates a lower transformation temperature and hence finer interlamellar spacing. The high volume fraction of hard cementite and fine interlamellar spacing provides the wear resistance and contributes towards the increased RCF resistance of the composition included in an embodiment of the invention.

Silicon improves the strength by solid solution hardening of ferrite in the pearlite structure over the range of 0.75 to 0.95%. A silicon content of from 0.75 to 0.92% was found to provide a good balance in ductility and toughness of the rail as well as weldability. At higher values the ductility and toughness values quickly drop and at lower values, the wear and particularly RCF resistance of the steel diminishes rapidly. Silicon, at the recommended levels, also provides an effective safeguard against any deleterious network of embrittling cementite at grain boundaries. Preferably, the minimum silicon content is 0.82%. The range from 0.82 to 0.92 proved to provide a very good balance in ductility and toughness of the rail as well as weldability.

Manganese is an element which is effective for increasing the strength by improving hardenability of pearlite. Its primary purpose is to lower the pearlite transformation temperature. If its content is less than 0.80% the effect of manganese was found to be insufficient to achieve the desired hardenability at the chosen carbon content and at levels above 0.95% there is an increased risk of formation of martensite because of segregation of manganese. A high manganese content makes the welding operation more difficult. In a preferable embodiment, the manganese content is at most 0.90%. Preferably, the phosphorus content of the steel is at most 0.015%. Preferably, the aluminium content is at most 0.006%.

Sulphur values have to be between 0.008 and 0.030%. The reason for a minimum sulphur content is that it forms MnS inclusions which act as a sink for any residual hydrogen that may be present in the steel. Any hydrogen in rail can result in what are known as shatter cracks which are small cracks with sharp faces which can initiate fatigue cracks in the head (known as tache ovals) under the high stresses from the wheels. The addition of at least 0.008% of sulphur prevents the deleterious effects of hydrogen. The maximum value of 0.030% is chosen to avoid embrittlement of the structure. Preferably, the maximum value is at most 0.020%. In a preferred embodiment, the steel according to the invention consists of:

0.90% to 0.95% carbon,
0.82% to 0.92% silicon,
0.80% to 0.95% manganese,
0.08% to 0.12% vanadium,
0.003 to 0.007% nitrogen,
at most 0.015% phosphorus,
0.008 to 0.030% sulphur
at most 2 ppm hydrogen
at most 0.10% chromium
at most 0.004% aluminium
at most 20 ppm oxygen
the remainder consisting of iron and unavoidable impurities,
and having a pearlitic structure The RCF and wear resistance have been measured using a laboratory twin-disc facility similar to the facility described in R. I. Carroll, Rolling Contact Fatigue and surface metallurgy of rail, PhD Thesis, Department of Engineering Materials, University of Sheffield, 2005. This equipment simulates the forces arising when the wheel is rolling and sliding on the rail. The wheel that is used in these tests is an R8T-wheel, which is the standard British wheel. These assessments are not part of the formal rail qualification procedure but have been found to provide a good indicator as to the relative in-service performance of different rail steel compositions. The test conditions for wear testing involve use of a 750 MPa contact stress, 25% slip and no lubrication while those for RCF utilise a higher contact stress of 900 MPa, 5% slip and water lubrication.

The invention has demonstrated that its resistance to rolling contact fatigue is much greater than conventional heat treated rails. In the as rolled condition it has demonstrated an increase in the number of cycles to crack initiation of over 62% (130000 cycles) compared to pearlitic rails with hardness of 370 HB (80000 cycles). Heat treatment of the invention increases its RCF resistance still further to 160000 cycles.

In an embodiment of the invention a pearlitic rail is provided having an RCF resistance of at least 130,000 cycles to initiation under water lubricated twin disc testing conditions. As described above, these values are under rolling and sliding conditions.

In an embodiment of the invention a pearlitic rail is provided with a wear resistance comparable to heat treated current rail steels, preferably wherein the wear is lower than 40 mg/m of slip at a hardness between 320 and 350 HB, or lower than 20 mg/m, preferably below 10 mg/m of slip at a hardness above 350 HB when tested as described above.

The invention has demonstrated during twin disc testing its resistance to wear is as effective as the hardest current heat treated rails. In the as rolled condition the wear resistance of the rail is greater than conventional heat treated rails with a higher hardness of 370 HB. In the heat treated condition the rails have a very low wear rate similar to conventional rails with a hardness of 400 HB.

The maximum recommended level of unavoidable impurities are based on EN13674-1:2003, according to which the maximum limits are Mo 0.02%, Ni 0.10%, Sn-0.03%, Sb-0.020%, Ti-0.025%, Nb-0.01%.

According to some non-limiting examples two casts A and B with designed variations in the selected alloying elements were made and cast into ingots. The chemical compositions of these examples are given in Table 1.

TABLE 1a

| Chemical composition, wt % | | | | | | | | | |
|---|---|---|---|---|---|---|---|---|---|
| | C | Si | Mn | P | S | Cr | V | Al | N |
| A | 0.94 | 0.96 | 0.84 | 0.011 | 0.005 | 0.05 | 0.11 | 0.004 | 0.004 |
| B | 0.92 | 0.83 | 0.88 | 0.012 | 0.007 | 0.06 | 0.12 | 0.003 | 0.005 |

The ingots were cogged to the standard 330×254 rail bloom section and rolled to 56E1 sections. All rail lengths were produced free from any internal or surface breaking defects. The rails were tested in the as-hot-rolled condition and in a controlled accelerated cooled condition.

The hardness of the steels was found to be between 342 HB and 349 HB. When relying on hardness for rail life estimation this would lead to the conclusion that the steels do not meet the Grade 350 HT minimum. However, the inventors found that by selecting a steel in the narrow chemistry window in accordance with the invention that both wear resistance and RCF resistance are excellent and outperform the Grade 350 whilst showing similar mechanical properties. In the heat treated condition (i.e. the accelerated cooled version) the hardness is about 400 HB.

TABLE 1b

| Chemical composition, wt % except N (ppm) | | | | | | | | | |
|---|---|---|---|---|---|---|---|---|---|
| | C | Si | Mn | P | S | Cr | V | Al | N |
| A* | 0.94 | 0.92 | 0.84 | 0.010 | 0.008 | 0.04 | 0.10 | 0.002 | 40 |
| B* | 0.92 | 0.87 | 0.88 | 0.010 | 0.010 | 0.05 | 0.10 | 0.002 | 30 |
| C | 0.92 | 0.92 | 0.85 | 0.014 | 0.012 | 0.02 | 0.11 | 0.001 | 37 |
| D | 0.95 | 0.89 | 0.88 | 0.015 | 0.016 | 0.02 | 0.11 | 0.001 | 41 |
| E | 0.94 | 0.87 | 0.85 | 0.010 | 0.014 | 0.02 | 0.12 | 0.002 | 43 |

The steels in Table 1b were commercial trials. The results obtained with these steels confirmed the results of the laboratory casts. The wear resistance of the commercial casts was even better than those of the laboratory casts. This is believed to be due to the finer pearlite and finer microstructure obtained in the industrial trials. For instance, the wear rate (in mg/m of slip) for steel C turned out to be 3.6 whereas the values for steels A and B are in the order of 25. The latter values are already very good in comparison to typical values for R260 and R350HT (124 and 31 respectively), but the commercial trials even exceed the values of the laboratory trials. The RCF-resistance is also significantly higher for the commercial trial casts with 200000-220000 cycles to crack initiation. The laboratory trials were 130000-140000. This improvement is at least partly attributable to the sulphur content being above the critical value of 0.008% for the commercial trial casts, but also to the finer pearlite and finer microstructure obtained in the industrial trials. Again these values were already much better than the typical values for R260 and R350HT which are 50000 and 80000 respectively. The hardness values measured in the rail are very consistent over the entire cross-section of the rail.

The steels were also welded by Flash Butt Welding and Aluminothermic Welding, and in both cases the welds proved to meet the required standard for homogeneous welds (same materials) and heterogeneous welds (different materials).

TABLE 2

| Tensile properties | | | |
|---|---|---|---|
| Steel Grade | Condition | 0.2% Proof Strength (MPa) | Tensile strength (MPa) |
| Grade 350HT | Heat treated | 763 | 1210 |
| A | As-rolled | 659 | 1240 |
| B | As-rolled | 764 | 1230 |
| A | Accelerated Cooled | 981 | 1460 |
| B | Accelerated Cooled | 910 | 1404 |

All other relevant properties are similar or better than those of currently available pearlitic rail steel grades thereby resulting in a rail with an excellent combination of wear properties and rolling contact fatigue resistance as well as similar or better properties than those of currently available pearlitic rail steel grades.

In FIG. 1 the number of cycles to RCF initiation of the rails according to the invention (circles) is compared to the values for conventional pearlitic steels (squares) as a function of the hardness of the rail (in HB). It is clear that the rails according to the invention outperform the known rails and show a step change improvement in their resistance to rolling contact fatigue. The results of the industrial trials are shown as well (triangle).

Figure 2:
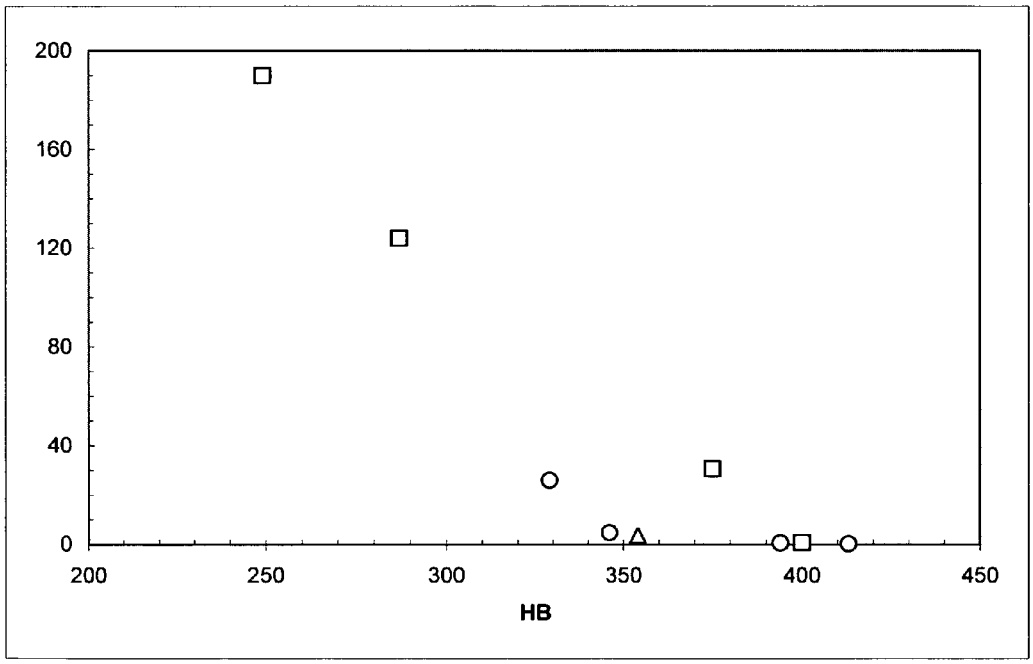

In FIG. 2 the wear properties of the rails according to the invention (circles) in mg/m of slip is compared to the values for conventional pearlitic steels (squares) as a function of the hardness of the rail (in HB). The wear rate of the rails according to the invention is lower than current rail steels for hardness of below 380 HB and is comparable for rails with hardness values of greater than 380 HB. The results of the industrial trials are shown as well (triangle).

The invention claimed is:

1. A high-strength pearlitic steel rail with an excellent combination of wear properties and rolling contact fatigue resistance wherein the steel consists of 0.88% to 0.95% carbon,
0.75% to 0.95% silicon,
0.80% to 0.95% manganese,
0.08% to 0.14% vanadium,
0.003 to 0.005% nitrogen,
up to 0.030% phosphorus,
0.012% to 0.030% sulphur,
at most 2.5 ppm hydrogen,
at most 0.10% chromium,
at most 0.010% aluminium,
at most 20 ppm oxygen,
the remainder being iron and unavoidable impurities.

2. Pearlitic rail according to claim 1, wherein carbon is 0.90% to 0.95%.

3. Pearlitic rail according to claim 1, wherein vanadium is 0.08% to 0.12%.

4. Pearlitic rail according to claim 1, wherein nitrogen is 0.003 to 0.0037%.

5. Pearlitic rail according to claim 4, wherein vanadium is 0.08% to 0.12% and sulfur is 0.014 to 0.030%.

6. Pearlitic rail according to claim 1, consisting of 0.90% to 0.95% carbon,
0.82% to 0.92% silicon,
0.80% to 0.95% manganese,
0.08% to 0.12% vanadium,
0.003 to 0.005% nitrogen,
at most 0.015% phosphorus,
0.012% to 0.030% sulphur,
at most 2 ppm hydrogen,
at most 0.10% chromium,
at most 0.004% aluminium,
at most 20 ppm oxygen,
the remainder consisting of iron and unavoidable impurities.

7. Pearlitic rail according to claim 1, wherein manganese is 0.80% to 0.90%.

8. Pearlitic rail according to claim 1, having an RCF resistance of at least 130,000 cycles to initiation under water lubricated twin disc testing conditions.

9. Pearlitic rail according to claim 1, wherein the wear is lower than 40 mg/m of slip at a hardness between 320 and 350 HB, or lower than 20 mg/m of slip at a hardness above 350 HB.

10. Pearlitic rail according to claim 1, wherein sulfur is at most 0.020%.

11. Pearlitic rail according to claim 1, wherein vanadium is 0.10 to 0.12%.

12. Pearlitic rail according to claim 4, wherein vanadium is 0.10 to 0.12%.

13. Pearlitic rail according to claim 1, wherein the wear is lower than 40 mg/m of slip at a hardness between 320 and 350 HB.

14. Pearlitic rail according to claim 1, wherein the wear is lower than 20 mg/m of slip at a hardness above 350 HB.

15. Pearlitic rail according to claim 1, wherein the wear is lower than 10 mg/m of slip at a hardness above 350 HB.

16. Pearlitic rail according to claim 1, wherein the impurities consist of:

at most 0.02% Mo,
at most 0.10% Ni,
at most 0.03% Sn,
at most 0.02% Sb,
at most 0.025% Ti,
at most 0.01% Nb.

17. Pearlitic rail according to claim 6, wherein the impurities consist of:

at most 0.02% Mo,
at most 0.10% Ni,
at most 0.03% Sn,
at most 0.02% Sb,
at most 0.025% Ti,
at most 0.01% Nb.

18. Pearlitic rail according to claim 17, wherein chromium is 0.02% to 0.04% and sulfur is 0.016% to 0.030%.

19. Pearlitic rail according to claim 17, consisting of 0.90% to 0.92% carbon,
0.89% to 0.92% silicon,
0.80% to 0.85% manganese,
0.11% to 0.12% vanadium,
0.003 to 0.0037% nitrogen,
0.012 to 0.015% phosphorus,
0.012 to 0.030% sulfur,
at most 2 ppm hydrogen,
0.02% to 0.04% chromium,
at most 0.004% aluminium,
at most 20 ppm oxygen,
the remainder consisting of iron and unavoidable impurities.

20. Pearlitic rail according to claim 19, wherein sulfur is 0.012% to 0.020%.

* * * * *